United States Patent [19]

Püntener et al.

[11] Patent Number: 4,818,246

[45] Date of Patent: Apr. 4, 1989

[54] PROCESS FOR IMPROVING THE LIGHT-FASTNESS OF LEATHER DYEINGS

[75] Inventors: Alois Püntener, Rheinfelden, Switzerland; Gerhard Back, Lörrach, Fed. Rep. of Germany; Josef Koller, Reinach, Switzerland

[73] Assignee: Ciba-Geigy Corporation, Ardsley, N.Y.

[21] Appl. No.: 97,269

[22] Filed: Sep. 17, 1987

Related U.S. Application Data

[63] Continuation of Ser. No. 796,446, Nov. 8, 1985, abandoned.

[30] Foreign Application Priority Data

Nov. 9, 1984 [CH] Switzerland ..... 5389/84

[51] Int. Cl.[4] ..... D06P 3/32

[52] U.S. Cl. ..... 8/437; 8/941 R; 8/436; 8/624

[58] Field of Search ..... 8/436, 437, 624, 94.1 R

[56] References Cited

U.S. PATENT DOCUMENTS

| | | | |
|---|---|---|---|
| 837,105 | 11/1906 | Oakes | 8/436 |
| 1,536,725 | 5/1925 | Onnertz | 8/436 |
| 1,716,218 | 6/1929 | Escaich et al. | 8/436 |
| 2,090,396 | 8/1937 | Chapin et al. | 8/625 |
| 2,741,535 | 4/1956 | Streck | 8/74 |
| 2,908,543 | 10/1959 | Kirk | 8/437 |
| 3,075,821 | 1/1963 | Goldemberg et al. | 8/10 |
| 3,561,914 | 2/1971 | Abel et al. | 8/404 |
| 4,116,952 | 9/1978 | Beffa et al. | 534/695 |
| 4,315,854 | 2/1982 | Puntener et al. | 534/696 |
| 4,383,835 | 5/1983 | Preuss et al. | 8/602 |
| 4,544,372 | 10/1985 | Heise et al. | 8/602 |
| 4,655,785 | 4/1987 | Reinert et al. | 8/624 |

FOREIGN PATENT DOCUMENTS

| | | |
|---|---|---|
| 0018775 | 11/1980 | European Pat. Off. . |
| 417209 | 8/1925 | Fed. Rep. of Germany . |
| 1079248 | 4/1960 | Fed. Rep. of Germany . |
| 128085 | 3/1979 | Japan . |
| 261948 | 9/1949 | Switzerland . |
| 614142 | 6/1978 | U.S.S.R. . |

OTHER PUBLICATIONS

Venkataraman, *The Chemistry of Synthetic Dyes* vol. VIII, pp. 37, 38, 39 Academic Pres 1978.

Encyclopedia of Chemical Technology vol. 8, p. 331, Wiley New York 1979.

Heidemann, Das Leder 29, pp. 105–111 (1978).

Derwent Japanese, vol. 4, No. 47, p. 6 (1965 (Abstracting Japanese 40–26876, Nov. 24, 1965).

Chemical Abstracts, 82, p. 89, No. 157846W.

*Primary Examiner*—Paul Lieberman
*Assistant Examiner*—Linda D. Skaling
*Attorney, Agent, or Firm*—Wenderoth, Lind & Ponack

[57] ABSTRACT

For improving the light-fastness of leather dyed with anionic dyes, the leather is treated, before, during or after dyeing, with a compound of copper.

16 Claims, No Drawings

PROCESS FOR IMPROVING THE LIGHT-FASTNESS OF LEATHER DYEINGS

This application is a continuation of now abandoned application Ser. No. 796,446, filed Nov. 8, 1985, abandoned.

The present invention relates to a process for improving the light-fastness of leather dyed with anionic dyes, which process comprises treating the leather, before, during or after dyeing, with a compound of nickel, cobalt or copper.

Suitable compounds of nickel, cobalt or copper are for example salts of inorganic or organic acids, and also compounds which contain the stated metals in complexed form. Also suitable are mixtures of these compounds.

Preferably used are compounds of copper, for example the following: salts of inorganic acids, such as copper chloride, copper sulfate, copper phosphate or copper nitrate; salts of organic acids, for example copper acetate, copper tartrate or copper salicylate; and there can also be used mixtures of various copper salts, or mixtures of one copper salt and a further acid, for example mixtures of copper acetate and salicylic acid.

Suitable also are copper salts of salicylic acid derivatives, or mixtures of the above-mentioned copper salts of inorganic or organic acids with salicylic acid derivatives. Applicable salicylic acid derivatives are for example 2-hydroxy-5-sulfobenzoic acid or compounds of the formula I

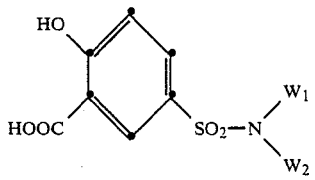

(I)

wherein $W_1$ and $W_2$ independently of one another are each hydrogen, $C_1$–$C_4$ -alkyl, hydroxy-$C_1$–$C_4$-alkyl, or phenyl unsubstituted or substituted by sulfo or carboxyl.

Suitable complex compounds are for example copper, cobalt or nickel complexes of bisazomethines, acylhydrazones, semicarbazones and thiosemicarbazones of aromatic aldehydes or ketones, which complexes can optionally contain sulfo groups.

By bisazomethines of aromatic aldehydes and ketones are meant here Schiff bases of aliphatic or aromatic diamines, the aldehydes and ketones having in the o-position with respect to the formyl or acyl radical an OH group. The bond with the metal atom occurs by way of these two OH groups and the two nitrogen atoms in the bisazomethine moiety. It is accordingly a case here of tetradentate ligands. The ligands preferably contain one or more sulfo groups, which are in the aldehyde or ketone moiety and/or in the bisazomethine bridge.

There are used for example bisazomethine metal complexes of the formula II

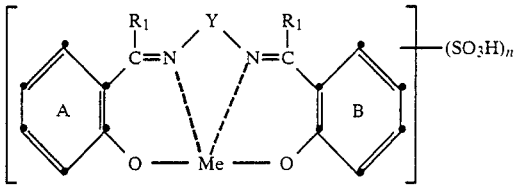

(II)

wherein $R_1$ is hydrogen or an unsubstituted or substituted alkyl or aryl radical, Y is an unsubstituted or substituted alkylene or arylene radical, Me is copper, cobalt or nickel, and n is 1 to 3. The benzene rings A and B can likewise be substituted, independently namely of one another, or can also contain further fused-on rings. There can moreover be in place of the benzene rings A and B also heterocyclic rings.

When $R_1$ is an unsubstituted or substituted alkyl radical, it is preferably a $C_1$–$C_8$-alkyl radical, in particular a $C_1$–$C_4$-alkyl radical, which can be either branched-chain or straight-chain, and can be substituted by halogen, such as fluorine, chlorine or bromine, or by $C_1$–$C_4$-alkyoxy, such as methoxy or ethoxy, by a phenyl or carboxyl radical, by $C_1$–$C_4$-alkoxycarbonyl, such as by the acetyl radical, or by hydroxyl or a mono- or dialkylated amino group. It can furthermore be the cyclohexyl radical, which can likewise be substituted, for example by $C_1$–$C_4$-alkyl or $C_1$–$C_4$-alkoxy.

When $R_1$is an unsubstituted or substituted aryl radical, it is especially by a phenyl or naphthyl radical whcih can be substituted by $C_1$–$C_4$-alkyl, such as methyl, ethyl, propyl, isopropyl, butyl, isobutyl, sec-butyl and tert-butyl, $C_1$–$C_4$-alkoxy, such as methoxy, ethoxy, propoxy, isopropoxy, butoxy, isobutoxy, sec-butoxy and tert-butoxy, halogen, such as fluorine, chlorine and bromine, $C_2$–$C_5$-alkanoylamino, such as acetylamino, propionylamino and butyrylamino, nitro, cyano, sulfo or a mono- or dialkylated amino group.

When Y is an alkylene radical, it is particularly a $C_2$–$C_4$-alkylene radical, especially a —$CH_2$—$CH_2$— bridge. Also applicable however is a $C_2$–$C_8$-alkylene chain interrupted by oxygen and in particular by nitrogen, above all the —$(CH_2)_3$—NH—$(CH_2)_3$— bridge.

When Y is an arylene radical, it is primarily a phenylene radical, particularly an o-phenylene radical. This can likewise be substituted by $C_1$–$C_4$-alkyl, or by $C_1$–$C_4$-alkoxy.

Substituents for the benzene rings A and B are: $C_1$–$C_4$-alkyl, $C_1$–$C_4$-alkoxy, or halogen, such as fluorine, chlorine or bromine, also the cyano or nitro group.

There are used in particular in the present process the copper complexes of the formula I wherein $R_1$ is hydrogen, Y is the ethylene or o-phenylene bridge, and n is 2, the two sulfo groups being in the benzene rings A and B; and especially the complexes in which the sulfo groups are in each each arranged in the p-position with respect to the oxygen atom.

In the case of the copper, cobalt and nickel complexes of acylhydrazones of aromatic aldehydes and ketones, which complexes contain sulfo groups, they are in the first place complexes of the formula III

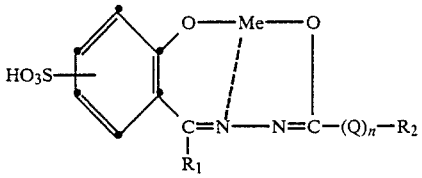

(III)

wherein $R_1$ has the meaning defined in the foregoing under the formula II, Q is oxygen or NH, and n is zero or 1, and $R_2$ is hydrogen or an unsubstituted or substituted alkyl or aryl radical. The symbol Me again denotes copper, cobalt or nickel.

When $R_2$ is an alkyl radical, this can be branched-chain or straight-chain, and has a chain-length of preferably 1 to 8, especially 1 to 4, C atoms. Applicable substituents are halogen, such as fluorine, chlorine or bromine, $C_1$–$C_4$-alkoxy, such as methoxy or ethoxy, also phenyl or carboxyl, $C_1$–$C_4$-alkoxycarbonyl, for example acetyl or hydroxyl, or mono- or dialkylamino.

When $R_2$ is an unsubstituted or substituted aryl radical, it is in particular a phenyl or naphthyl radical which can be substituted by $C_1$–$C_4$-alkyl, such as methyl, ethyl, propyl, isopropyl, butyl, isobutyl, sec-butyl and tert-butyl, $C_1$–$C_4$-alkoxy, such as methoxy, ethoxy, propoxy, isopropoxy, butoxy, isobutoxy, sec-butoxy and tert-butoxy, halogen, such as fluorine, chlorine and bromine $C_2$–$C_5$-alkanoylamino, such as acetylamino, propionylamino and butyrylamino, nitro, cyano or sulfo, or a mono- or dialkylated amino group.

There are preferably used complexes of the formula III in which $R_1$ is hydrogen, and $R_2$ is hydrogen, methyl or especially the phenyl radical, and in which the metal contained is copper, above all the complexes wherein the sulfo group again is in the p-position with respect to the oxygen atom.

By copper, cobalt and nickel complexes of semicarbazones or thiosemicarbazones in the present process are meant in the first place complexes of the formula IV

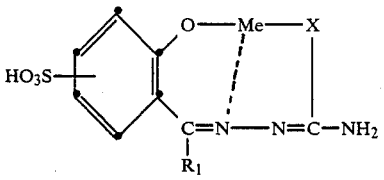

(IV)

wherein $R_1$ has the meaning already defined in connection with the formula I, and X is oxygen or sulfur. Me denotes copper, cobalt or nickel.

Besides the transition-metal complexes of the formulae III and IV, of which the ligands are derived from sulfosalicylaldehyde or from the corresponding phenylketones, there are applicable for example also those in the case of which there have been used for the build-up of the ligands, instead of mononuclear, polynuclear aromatic aldehydes and ketones, such as 2-hydroxy-1-naphthaldehydesulfonic acids. Reference is moreover made to the fact that the fourth coordination position of the metal atom in the complex of the formulae III and IV is occupied by for example water as neutral ligand.

Also applicable in the process according to the invention are the copper, cobalt or nickel complexes of compounds of the formula V

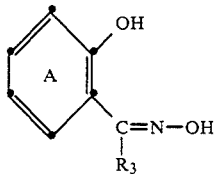

(V)

wherein $R_3$ is H, OH, alkyl or cycloalkyl, and wherein the ring A can optionally contain further substituents, for example sulfo or sulfonamide groups.

Suitable alkyl radicals are those having 1 to 4 C atoms. Cycloalkyl radicals which are suitable are cyclohexyl and methylcyclohexyl radicals. And suitable substituents in the ring A are for example methyl, methoxy or chlorine. This ring is however preferably unsubstituted.

Also suitable for the process according to the invention are compounds of the formula IV

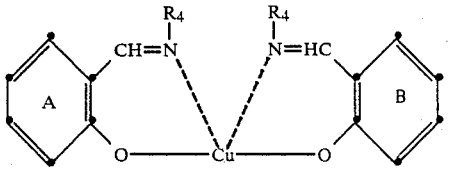

(VI)

wherein $R_4$ is $C_1$–$C_{18}$-alkyl or cycloalkyl, and the rings A and B can be substituted by $C_1$–$C_4$-alkyl, cycloalkyl, $C_1$–$C_4$-alkoxy, halogen or OH, or can also contain further fused-on rings. Furthermore, there can be in place of the rings A and B also heterocyclic rings.

The stated complex compounds which contain sulfo groups are preferably used as alkali metal salt, in particular sodium salt, or as amine salt.

The preferred compounds for the process according to the invention are: copper(II) chloride, -sulfate, -nitrate or -acetate, and also mixtures of these salts with tartaric acid or salicylic acid.

The metal compounds are advantageously applied from an aqueous bath, and in an amount of 0.1 to 10 % by weight, preferably 0.5 to 5% by weight, relative to the weight of the leather.

The treatment with the metal compound can be carried out before, during or after dyeing. With the use of salts of nickel, cobalt or copper, there is preferably performed after the dyeing and rinsing of the leather an aftertreatment in a fresh aqueous liquor containing the metal compound as well as optionally acids and/or salts to obtain a specific pH value.

The treatment is performed for example at a pH value of between 3 and 7 at 20° to 100° C. for about 10 to 60 minutes.

The dyeings of the leather can be produced in the customary manner with the usual anionic leather dyes.

In the case of the anionic dyes, they are for example salts of heavy-metal-containing or metal-free mono-, dis- or polyazo dyes, including the azomethine and formazan dyes, as well as the anthraquinone, xanthene, nitro, triphenylmethane, naphthoquinoneimine and phthalocyanine dyes. The anionic character of these dyes can be brought about by metal-complex formation alone and/or by acidic, salt-forming substituents, such as carboxylic acid groups, sulfuric acid ester groups and phosphonic acid ester groups, phosphonic acid groups, alkylsulfone, sulfonamido or sulfonic acid groups. The 1:1 or 1:2 metal complex dyes are preferred. The 1:1 metal complex dyes preferably contain one or two sulfonic acid groups. They contain as metal a heavy-metal atom, for example copper, nickel, iron and especially chromium.

The 1:2 metal complex dyes contain as central atom a heavy-metal atom, for example an iron, cobalt or in particular a chromium atom. With the central atom are linked two complex-forming components, of which at least one is a dye molecule; preferably however both are dye molecules. The two dye molecules concerned in the complex formation can be identical or different from one another. The 1:2 metal complex dyes can contain for example two azomethine molecules, an azo and an azomethine due or two azo dyes; and these dyes can be substituted by further arylazo and/or arylazoaryleneazo groups. By aryl are meant here particularly benzene or naphthalene radicals, which are unsubstituted or substituted by for example: nitro, sulfo, halogen, alkyl or alkoxy. The azo or azomethine dye molecules can contain water-solubilising groups, for example acid amide, alkylsulfonyl or the above-mentioned acid groups. The 1:2 cobalt or 1:2 chrome complexes of monoazo dyes which contain the acid amide, alkylsulfonyl or sulfonic acid groups are preferred.

The cationic dyes concerned are metal-free or metal-containing dyes. These dyes can belong to various classes of dyes. They are in particular salts, for example chlorides, sulfates, onium chlorides or metal halides, for example zinc chloride salts or azo dyes, such as monoazo dyes or hydrazone dyes, anthraquinone, diphenylmethane, triphenylmethane, methine or azomethine dyes, ketonimine, cyanine, azine, oxazine or thiazine dyes.

Particularly suitable dyes correspond to the formula VII

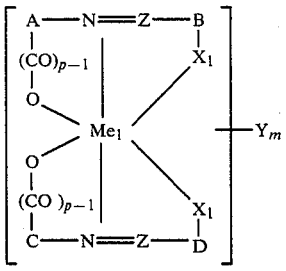

(VII)

wherein

Z independently of one another are each nitrogen or a CH group;

A and C independently of one another are each a radical of the benzene or naphthalene series, which radical contains in the o-position with respect to the azo or azomethine group a hydroxyl or carboxyl group, B and D independently of one another are each the radical of a coupling component when Z is nitrogen, the coupling component containing in the o- or α-position with respect to the azo group the group X, or independently of one another are each the radical of an o-hydroxyaldehyde when Z is the CH group, $X_1$ independently of one another are each oxygen or a group of the formula —$NR_5$—, in which $R_5$ is hydrogen or a $C_1$–$C_4$-alkyl group, $Me_1$ is chromium or cobalt, Y is the $SO_3H$, COOH, $PO_3H_2$ or $SO_2$-V group, in which V is $C_1$–$C_4$-alkyl, unsubstituted or substituted by halogen, vinyl, amino, N-mono- or N,N-dialkylamino, p is 1 or 2, and m is an integer from 0 to 6.

Suitable dyes of the formula VII are both symmetrical and asymmetrical 1:2 azo or 1:2 azomethine complexes, and also 1:2 complexes which contain an azo and an azomethine dye bound to the metal.

Of the dyes of the formula VII, there are preferably used those in which X is oxygen.

When dyes of the formula VII contain several groups Y, these can be identical or different. Preferably, however, all groups Y are $SO_3H$ groups.

Further dyes of the formula VII preferably used are those in which p is 1, as well as those in which m is 1 to 3, preferably 2.

The radicals A and C can in addition be further substituted by groups Y, especially by $C_1$–$C_4$-alkyl or $C_1$–$C_4$-alkoxy, chlorine or nitro.

Suitable diazo components A and C are for example: anthranilic acid, 4- or 5-sulfoanthranilic acid, 2-amino-1-hydroxybenzene, 4-chloro- and 4,6-dichloro-2-amino-1-hydroxybenzene, 4- or 5-nitro-2-amino-1-hydroxybenzene, 4-chloro- and 4-methyl-6-nitro-2-amino-1-hydroxybenzene, 6-chloro-4-nitro-2-amino-1-hydroxybenzene, 4-cyano-2-amino-1-hydroxybenzene, 4-methoxy-2-amino-1-hydroxybenzene, 4-methoxy-5-chloro-2-amino-1-hydroxybenzene, 4-methyl-2-amino-1-hydroxybenzene, 4-chloro-5-nitro-2-amino-1-hydroxybenzene, 3,4,6-trichloro-2-amino-1-hydroxybenzene, 4,6-dinitro-2-amino-1-hydroxybenzene, 2-amino-1-hydroxybenzene-4- or -5-sulfonic acid, 4-nitro-2-amino-1-hydroxybenzene-6-sulfonic acid, 5-nitro- or 6-nitro-2-amino-1-hydroxybenzene-4-sulfonic acid, 6-chloro-2-amino-1-hydroxybenzene-4-sulfonic acid, 4-chloro-2-amino-1-hydroxybenzene-6-sulfonic acid, 1-amino-2-hydroxynaphthalene-4-sulfonic acid, 1-amino-2-hydroxy-6-nitronaphthalene-4-sulfonic acid, 2-amino-1-hydroxybenzene-4,6-disulfonic acid, 1-amino-2-hydroxybenzene-4-sulfonic acid amide, 4-methylsulfonyl-2-amino-1-hydroxybenzene, 4-(2'-, 3'- or 4'-sulfophenylazo)-2-amino-1-hydroxybenzene, 4-(3'-sulfonamidophenylazo)-2-amino-1-hydroxybenzene, 4-(4'-phenylazophenylazo)-2-amino-1-1-hydroxybenzene, 1-amino-2-hydroxy-5-sulfonic acid anthranilide and 1-amino-2-hydroxy-5-(2'sulfo)-sulfonic acid anilide.

Preferably, A and C independently of one another are in each case the radical of a 1-hydroxy-2-aminobenzene, which is unsubstituted or mono- or polysubstituted by identical or different substituents from the group comprising nitro, sulfo, chlorine, methyl or methoxy; and especially the radical of a 1-hydroxy-2-aminobenzene, which carries in the 4- or 5-position a nitro group; or the radical of a 1-hydroxy-2-aminobenzene, which carries in the 4-position a nitro group and in the 6-position a sulfo group; or the radical of a 1-hydroxy-2-aminobenzene, which carries in the 4-position a sulfo group and in the 6-position a nitro group.

The radicals B and D are derived preferably from the following groups of coupling components: phenols which couple in the o-position and which are unsubstituted or substituted by low-molecular alkyl or alkoxy, amino or acylamino, where acylamino is $C_1$–$C_4$-alkanoylamino, $C_1$–$C_4$-alkylsulfonylamino, $C_1$–$C_4$-alkoxycarbonylamino, aroylamino or arylsulfonylamino radicals, resorcinol, m-phenylenediamine, unsubstituted or substituted in the 4-position by sulfo, chlorine, methyl or methoxy, naphthols, which are unsubstituted or substituted by $C_1$–$C_4$-alkyl or alkoxy, chlorine, amino, acylamino or sulfo, where acylamino has the same meaning as that given in the foregoing, 5-pyrazolones or 5-aminopyrazoles, which contain in the 1-position a phenyl or naphthyl radical unsubstituted or substituted by chlorine, nitro, $C_1$–$C_4$-alkyl or alkoxy groups or sulfo groups, and which contain in the 3-position a $C_1$–$C_4$-alkyl group, especially a methyl group; acetoacetic acid amides, acetoacetic acid anilides and benzoylacetic acid anilides, which can be substituted in the anilide nucleus by chlorine, $C_1$–$C_4$-alkyl or alkoxy or sulfo groups, or 6-hydroxy-3-cyano- or 6-hydroxy-3-carbonamido-4-alkyl-2-pyridones, which are substituted in the 1-position by unsubstituted or substituted $C_1$–$C_4$-alkyl, for example methyl, isopropyl, β-hydroxyethyl, β-aminoethyl or γ-isopropoxypropyl, or by phenyl, and which can carry in the 4-position a $C_1$–$C_4$-alkyl group, particularly methyl.

Examples of such coupling components are: 2-naphthol, 1,3- or 1,5-dihydroxynaphthalene, 1-naphthol, 1-acetyl-amino-7-naphthol, 1-propionylamino-7-naphthol, 1-carbo-methoxyamino-7-naphthol, 1-carboethoxyamino-7-naphthol, 1-carbopropoxyamino-7-naphthol, 6-acetyl-2-naphthol, 2-naphthol-3-, -4-, -5-, -6-, -7- or -8-sulfonic acid, 1-naphthol-3-, -4- or -5-sulfonic acid, 1-naphthol-3,6-disulfonic acid, 1-naphthol-4,8-disulfonic aid, 1-naphthol-3,8-disulfonic acid, 2-naphthol-3,6-disulfonic acid, 4-methyl-1-naphthol, 4-methoxy-1-naphthol, 4-acetyl-1-naphthol, 5,8-dichloro-1-naphthol, 5-chloro-1-naphthol, 2-naphthylamine, 2-naphthylamino-1-sulfonic acid, 1-naphthylamino-4- or -5-sulfonic acid, 2-aminoaphthalene-6- or -5-sulfonic acid, 1-phenyl-3-methylpyrazol-5-one, 1-phenyl-5-pyrazolone-3-carboxylic acid amide, 1-(2'-,3-, or 4'-methylphenyl)-3-methylpyrazol-5-one, 1-(2',3'- or 4'-sulfophenyl)-3-methylpyrazol-5-one, 1-(2'-chloro-5-sulfophenyl)-3-methylpyrzaol-5-one, 1-(2- or 4-methoxyphenyl-3-methylpyrazol-5-one, 1-(2-, 3- or 4-chlorophenyl)-3 1-(2'-, 3'- or 4'-nitrophenyl)-3-methylpyrazol-5-one, 1-(2'-,5'- or 3',4'-dichlorophenyl)-3-methylpyrazol-5-one, 1-(2',5'-dichloro-4'-sulfophenyl)-3-methylpyrazol-5-one, 1-(2',3'or 4'-sulfophenyl)-3-methyl-5-aminopyrazole, 1-(2'-chloro-5'-sulfophenyl)-3-methyl-5-aminopyrazole, acetoacetanilide, acetoacetanilide-2-, -3- or -4-sulfonic acid, acetoacet-o-anisidine, acetoacet-o-toluidide, acetoacet-o-chloroanilide, acetoacet-m-xylidide, tetralol, 4-methylphenol, 3-dialkyl-aminophenol, especially 3-dimethylamino- and 3-diethylaminophenol, 4-butylphenol, 4-amylphenol, particularly 4-t-amylphenol, 2-isopropyl-4-methylphenol, 2- or 3-acetylamino-4-methylphenol, 2-methoxycarbonylamino-4-methylphenol, 2-ethoxycarbonylamino-4-methylphenol and 3,4-dimethylphenol, resorcinol, 1-ethyl-3-cyano-4-methyl-6-hydroxypyridone, 1-methyl-3-cyano-4-methyl-6-hydroxypyridone and 1-phenyl-3-carbonamido-4-methyl-6-hydroxypyridone.

The coupling components B and/or D are preferably a 1- or 2-naphthol which is unsubstituted or substituted by a sulfo group, m-phenylenediamine, resorcinol, p-alkyl-($C_1$–$C_4$)-phenol, 1-phenyl-3-methyl-5-pyrazolone or acetoacetic acid anilide, and the phenyl group in the two last-mentioned compounds can be substituted by $C_1$–$C_4$-alkyl, $C_1$–$C_4$-alkoxy, chlorine or sulfo.

When Z is the —CH- group, B and/or D are the radical of an o-hydroxyaldehyde, preferably an o-hydroxybenzaldehyde or o-hydroxynaphthaldehyde. Suitable aldehydes are for example: 2-hydroxy-1-naphthaldehyde, 1-hydroxy-2-naphthaldehyde, 2-hydroxybenzaldehyde, 3- and 5-methyl-2-hydroxybenzaldehyde, 3,5-dimethyl-2-hydroxybenzaldehyde, 5-butyl-2-hydroxybenzaldehyde, 5-chloro- or 5-bromo-2-hydroxybenzaldehyde, 3-chloro-2-hydroxybenzaldehyde, 3,5-dichloro-2-hydroxybenzaldehyde, 5-sulfo-2-hydroxybenzaldehyde, 3-methyl-5-chloro-2-hydroxybenzaldehyde, 5-(phenylazo)-2-hydroxybenzaldehyde, 5-(2'-, 3'- or 4'-sulfophenylazo)-2-hydroxybenzaldehyde, 5-(6'-sulfonaphthyl-1'azo)-2-hydroxbenzaldehyde and 5-(4''-sulfo-4'-phenylazo)-phenylazo-2-hydroxybenzaldehyde.

The employed dyes are preferably in each case symmetrical 1:2 metal complexes having 2 sulfo groups, and particularly preferred are the dyes corresponding to the formula VIII

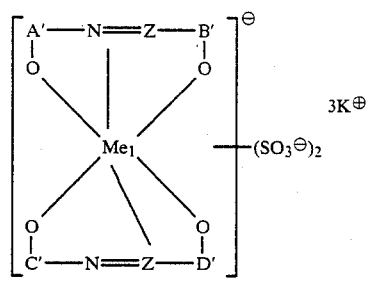

(VIII)

wherein

Z independently of one another are each a CH group or preferably nitrogen,

A' and C' are each the radical of a 1-hydroxy-2-aminobenzene which carries in the 4- or 5-position a nitro group, or the radical of a 1-hydrox-2-aminobenzene which carries in the 4-position a nitro group and in the 6-position a sulfo group, or the radical of a 1-hydrox-2-aminobenzene which carries in the 6-position a nitro group and in the 4-position a sulfo group, B' and D' independently of one another are each of radical of one of the following coupling components, when Z is nitrogen: 1 - or 2-naphthol which is unsubstituted or substituted by a sulfo group, m-phenylenediamine, resorcinol, p-alkyl($C_1$–$C_6$)-phenol, 1-phenyl-3-methyl-5-pyrazolone or acetoacetic acid anilide, and the phenyl group in the two last-mentioned compounds can be substituted by $C_1$–$C_4$-alkyl, $C_1$–$C_4$-alkoxy, chlorine or sulfo, or when Z is the CH group: the radical of an o-hydroxybenzaldehyde or o-hydroxynaphthaldehyde, which can each be substituted by phenylazo or sulfophenylazo, $Me_1$ is cobalt or chromium, and $Ka^{\oplus}$ is a cation.

Particularly preferred dyes correspond to the formula IX (IX)

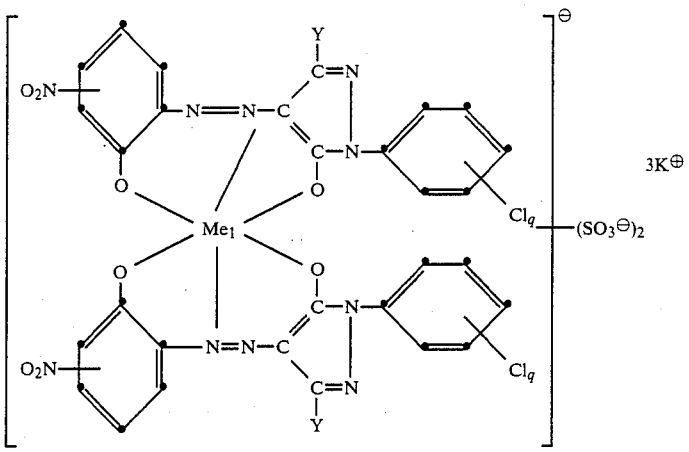

wherein q is an integer from 0 to 2, $Me_1$ is cobalt or chromium, $Ka^{\oplus}$ is a cation, and Y is methyl, $—CONH_2$ or —CO—NHR, in which R is an alkyl group having 1 to 4 C atoms; or to the formula X (X)

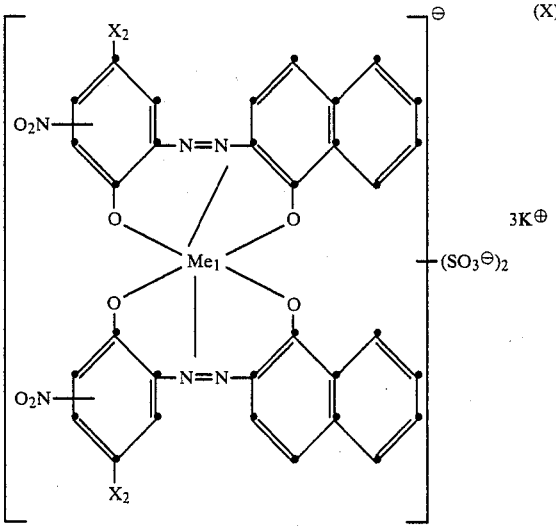

wherein $X_2$ is hydrogen, chlorine, methyl or methoxy, $Me_1$ is cobalt or chromium, and $Ka^{\oplus}$ is a cation; or to the formula XI (XI)

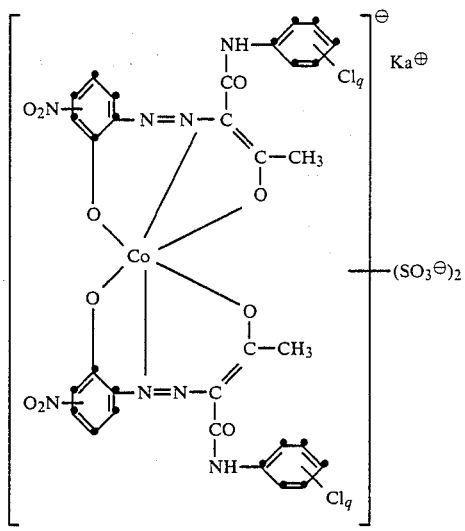

wherein q is an integer from 0 to 2, and $Ka^{\oplus}$ is a cation; or to the formula XII (XII)

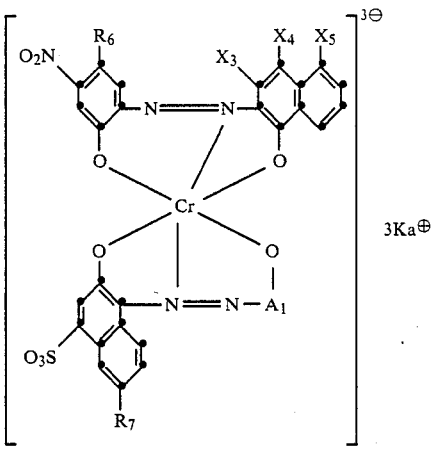

wherein $A_1$ is the radical of 1-hydroxynaphthalene or 2-hydroxynaphthalene, $R_6$ is hydrogen, chlorine or methyl, $R_7$ is hydrogen, nitro or chlorine, and $Ka^{\oplus}$ is a cation, and of the substituents $X_3$, $X_4$ and $X_5$, one is an $SO_3$ group and the two others are hydrogen, $X_5$ being hydrogen when $R_6$ is chlorine and $R_7$ hydrogen; or to the formula XIII

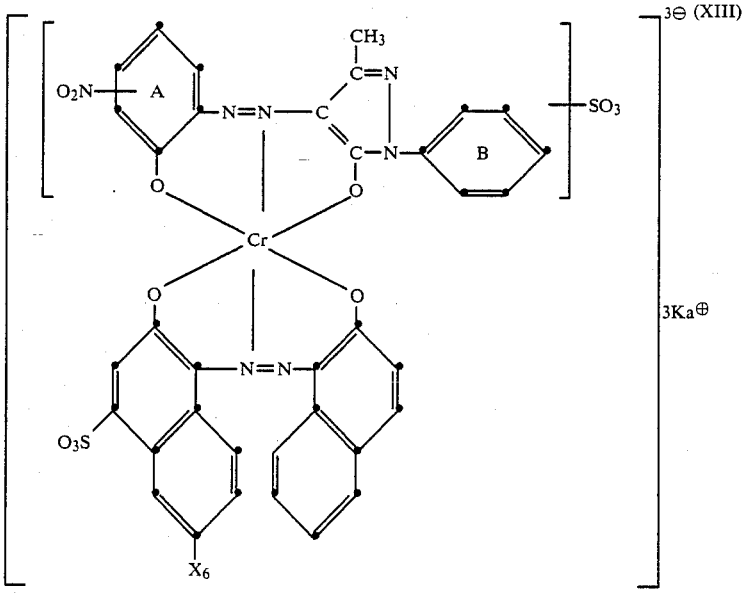

wherein $X_6$ is hydrogen, chlorine or nitro, and $Ka^{\oplus}$ is a cation, and wherein the sulfo group in the pyrazolone dye in the ring A or B and the nitro group in the ring A of this dye are arranged in the 4-, 5- or 6-position of the 1-hydroxy-2-aminobenzene; or to the formula XIV

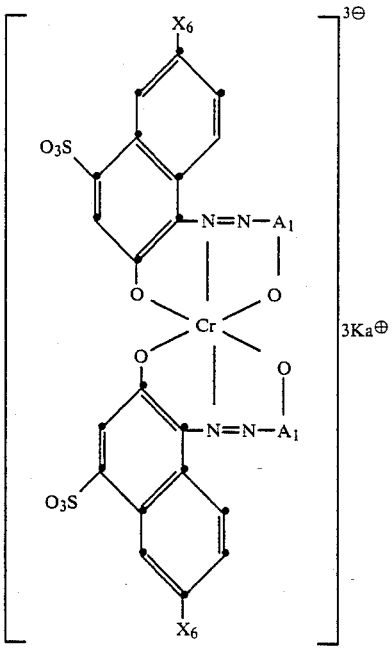

wherein $X_6$ is hydrogen, chlorine or nitro, $Ka^{\oplus}$ is a cation, and $A_1$ is the radical of 1-hydroxynaphthalene or 2-hydroxynaphthalene.

As a result of treatment with the metal compounds, the dyeings on leather produced with the dyes described in the foregoing are improved with respect to their fastness to light; for example, by about 1 or 2 ratings on the basis of the evaluation of the fastness to light according to SNV No. 95,809.

The process according to the present invention is particularly suitable for improving the light-fastness of leather dyeings obtained with a mixture of a yellow, of a red and of a blue dye of the type defined in the foregoing (that is to say, with a trichromic effect).

The following Examples serve to further illustrate the invention. The term 'parts' denotes parts by weight, and percentages are per cent by weight.

EXAMPLE 1

100 parts of pre-washed furniture leather are retanned for 60 minutes at 40° C. in a solution of 150 parts of water, 5 parts of tanning agent A (formaldehyde condensation product of phenolic acids) and 5 parts of tanning agent B (condensation product of a urea derivative with phenolic sulfonic acids) at a speed of 24 rotations per minute.

The leather is subsequently rinsed, and is then neutralised in a fresh liquor consisting of 200 parts of water, 2 parts of a neutralising agent based on ammonium salts of aromatic sulfonic acids and aliphatic dicarboxylic acids, as well as 2.5 parts of sodium bicarbonate, for a total of 60 minutes at 30° C.

After neutralisation, the leather is again rinsed, and, in preparation for the dyeing process, is pretreated for 15 minutes at 50° C. in an ammoniacal dye liquor consisting of 150 parts of water, 2 parts of 24% ammonia and 3 parts of tanning agent B. There are then added 1.3 parts of the yellow dye of the formula

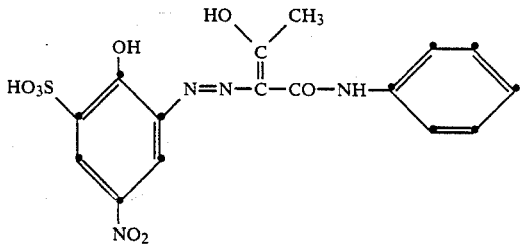

-continued

1:2 cobalt complex dissolved in 50 parts of water, as well as 0.5 part of a levelling agent of the alkylaminopolyglycol ether type. After a further 30 minutes, there are added to the dye bath also 10 parts of a fat-liquoring mixture formed from equal parts of a sulfited marine animal oil and a formulation based on sulfited hydrocarbons, fatty acids and derivatives thereof. Following the addition of the fat-liquoring agent, dyeing is continued for 60 minutes with the temperature remaining unchanged. The dye liquor is then acidified with 1 part of 85% formic acid, and the dyeing is continued for a further 30 minutes at 50° C.

The dyed leather is subsequently treated for 30 minutes in a new aftertreatment bath consisting of 200 parts of water at 50° C. and 3 parts of a mixture of copper acetate and salicylic acid in the molar ratio of 1:2, the pH value of the bath having been adjusted to 4.5 with formic acid. The material is then finished in the customary manner, and a section of the aftertreated dyeing, together with a section of a similar but not aftertreated dyeing, is irradiated in a Xenotest 450, Quarzlampen Gesellschaft, Hanau (Fed. Repub. of Germany) for 200 hours. The evaluation of the fastness to light is made with the aid of a simultaneously irradiated ISO blue scale having 8 dyeings graduated in fastness to light. It is shown that the dyeing aftertreated with the copper compound exhibits a clearly improved fastness to light.

EXAMPLE 2

The procedure is carried out as in Example 1 except that there is used for dyeing the re-tanned furniture leather a dye mixture consisting of 1.0 part of the yellowish-brown dye of the formula

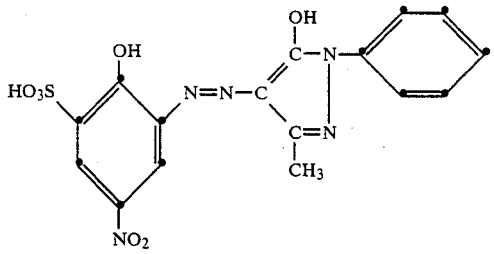

1:2 cobalt complex 0.05 part of the red dye of the formula

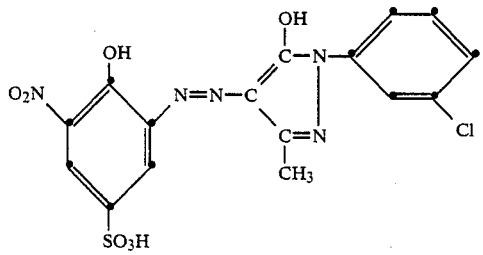

1:2 chrome complex and 0.05 part of the blue dye of the formula

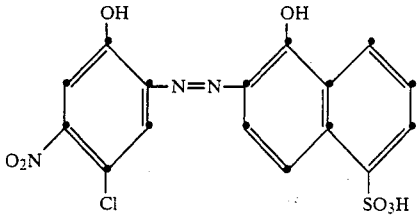

1:2 chrome complex the resulting brown dyeing is then aftertreated, in the manner described in Example 1, with 3 parts of a mixture of copper acetate and salicylic acid, and is afterwards irradiated simultaneously with a corresponding but not aftertreated dyeing under identical conditions in the Xenotest 450. After completion of the exposure test, the two dyeings are compared, the comparison showing that the dyeing aftertreated with the copper compound exhibits a clearly better fastness to light.

An aftertreatment with 3% (relative to the leather) of copper tartrate or 3% of copper sulfate results in an improvement in the fastness to light similar to that produced by an aftertreatment with 3% of the mixture of copper acetate and salicylic acid.

EXAMPLE 3

The re-tanned furniture leather is dyed in a manner analogous to that described in Example 1 except that there is used, in place of the yellow dye, 0.7 part of the dye of the formula

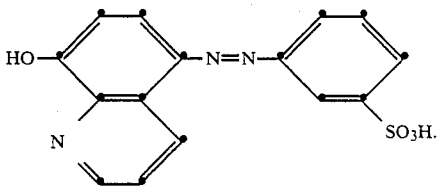

1:2 cobalt complex

The yellowish-brown dyeing is subsequently aftertreated with 3 parts of copper tartrate in the manner described in Example 1, and is then irradiated in the Xenotest 450 to determine the fastness to light.

The fastness to light of the aftertreated dyeing is clearly better than that of the dyeing not aftertreated.

Instead of aftertreating the leather with copper tartrate, it is possible to obtain an equally good result by aftertreating with 3% of a mixture of copper acetate and salicylic acid in the molar ratio of 1:2.

EXAMPLE 4

The black dyeing used for this Example is produced as follows:

100 parts of the furniture leather not intermediately dried are washed in 300 parts of water and 0.6 part of 40% acetic acid for 10 minutes at 30° C. There are then added 3 parts of a surface fat-liquoring agent formed from chlorinated hydrocarbons and n-alkyl derivatives, and the material is pretreated for a further 30 minutes. It is then neutralised in a fresh liquor consisting of 200 parts of water at 30° C. and 2 parts of a neutralising agent based on ammonium salts of aromatic sulfonic acids and aliphatic dicarboxylic acids. After a treatment duration of 15 minutes, there are also added 3 parts of a polymeric tanning agent and, after a further 20 minutes, 2 parts of sulfited marine animal oil, followed by 2.5 parts of sodium bicarbonate. The neutralisation is afterwards continued for 45 minutes. After neutralisation, the leather is again washed with 300 parts of water at 50° C. for 10 minutes.

For dyeing the leather, a dye liquor consisting of 200 parts of water at 50° C., 1 part of 24% ammonia and 1 part of the aforementioned neutralising agent is prepared. The neutralised leather is pretreated in this liquor for 10 minutes. There are then added 0.9 part of the black dye of the formula

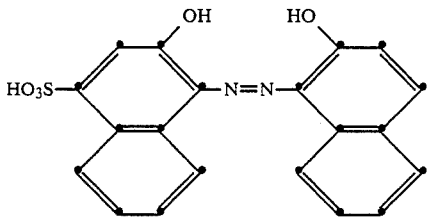

1:2 chrome complex and 0.5 part of a levelling agent of the alkylaminopolyglycol ether type. After a dyeing time of 30 minutes, the addition is made of a fat-liquoring mixture consisting of 2 parts of sulfited marine animal oil, 2 parts of sulfited fatty acid esters and animal fats and 2 parts of a formulation based on sulfited hydrocarbons, fatty acids and derivatives thereof. After a further 30 minutes, there are also added 4 parts of white tanning agent (condensation product of a urea derivative with phenolic sulfonic acids) and, after a further 45 minutes, 1.25 parts of 85% formic acid.

After a concluding treatment time of 30 minutes, the liquor is run off, and is replaced by a fresh liquor consisting of 0.4 part of the black dye mentioned in the foregoing and 200 parts of waters at 50° C. Dyeing is performed therein for a further 20 minutes. There are then added 2 parts of a fat-liquoring agent based on natural and modified oils and fats as well as n-alkyl derivatives and 1.5 parts of a handle-improving agent consisting of a fatty acid/polyamide condensation product. After a further 20 minutes, the dye liquor is acidified with 1 part of 85% formic acid, and dyeing is continued for a further 20 minutes.

The black leather dyeing is subsequently treated, in the manner described in Example 1, in a fresh bath at 50° C. with 3 parts of the mixture of copper acetate and salicylic acid. The leather is afterwards finished in the customary manner and then irradiated in the Xenotest.

The fastness to light of the aftertreated dyeing is clearly better than that of a dyeing not aftertreated.

EXAMPLE 5

When the procedure is carried out in the manner described in Examples 1 to 4 except that only 0.1% (relative to the weight of the leather) of the copper compounds is used, there is likewise obtained an improvement in the fastness to light.

EXAMPLE 6

100 parts of furniture leather not intermediately dried are re-tanned for 90 minutes in a liquor consisting of 200 parts of water at 50° C. and 8 parts of a condensation product of formaldehyde and phenolic sulfonic acids.

The leather is then washed for 15 minutes in 500 parts of water at 30° C., and is subsequently neutralised for 80 minutes in a liquor consisting of 300 parts of water at 30° C. and 1.5 parts of sodium formiate, to which liquor is added after 100 minutes also 2.5 parts of sodium bircarbonate. Following the neutralisation stage, there is performed a further washing operation for 10 minutes in 500 parts of water at 40° C.

The leather treated in this manner is then dyed for 30 minutes at 40° C. in a liquor consisting of 200 parts of water, 2 parts of 24% ammonia and 1.0 part of the yellow dye used in Example 1. There is subsequently added to the dye liquor a fat-liquoring mixture consisting of 8 parts of a formulation of sulfited hydrocarbons, fatty acids and derivatives thereof and 4 parts of sulfited fish oil, and, after a further 90 minutes, 3 parts of 85% formic acid are also added. Dyeing is afterwards continued for 30 minutes with the temperature unchanged.

The dyed and fat-liquored leather is then aftertreated in a fresh aftertreatment bath, adjusted to pH 5 with formic acid and consisting of 200 parts of water at 50° C. and 1.0 part of the copper compound of the formula

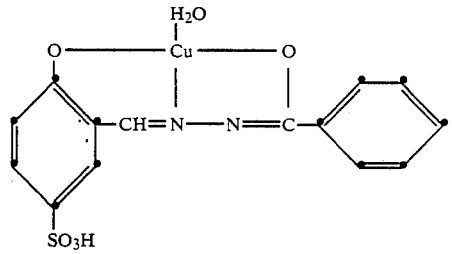

for 30 minutes. The leather is subsequently finished in the customary manner, and a section of the aftertreated dyeing together with a section of a similar but not aftertreated dyeing is then irradiated for 100 hours in a Xenotest 450 irradiation apparatus. It can be thus established that the dyeing aftertreated with the copper compound exhibits a clearly better fastness to light.

If the aftertreatment is carried out, not as described above in a fresh bath, but directly following the dyeing and fat-liquoring in the dye bath itself, a similar improvement in the fastness to light is obtained. In this case the pH value of the treatment liquor, conditioned by the dyeing process, is about 4 and the temperature 40° C.

The copper compound of the above-given formula is produced as follows:

2.24 parts of the sodium salt of 2-hydroxybenzaldehyde-5-sulfonic acid are dissolved in 20 parts of water at 70° C. After the addition of 1.36 parts of benzoic acid hydrazide, the reaction mixture is held for 1 hour at 90° to 95° C., in the course of which a clear yellow solution of the hydrazone compound is formed. To effect conversion into the copper complex, there is added to the resultign reaction solution a solution of 1.7 parts of $CuCl_2.2H_2O$ and 4 parts of crystallised sodium acetate in 10 parts of water, and the temperature is subsequently held at 70° to 75° C. for 30 minutes. The 1:1 copper complex occurring as a greenish-yellow precipitate is completely dissolved by the addition of 2 N sodium hydroxide solution until the pH value is 9.0 to 9.5. The yellowish-green solution is evaporated to dryness to thus obtain 7 parts of a copper complex in the form of an olive-green, readily water-soluble powder.

What is claimed is:

1. Process for improving the light-fastness of leather dyed with an anionic cobalt or chrome complex dye, which process comprises treating the leather before, during or after dyeing with a composition consisting essentially of a light-fastness improving amount of a compound of copper selected from the group consisting of (1) a copper salt of an inorganic or organic acid, (2) a copper salt of an inorganic or organic acid in admixture with a further organic carboxylic acid, (3) an acylhydrazone copper complex of the formula

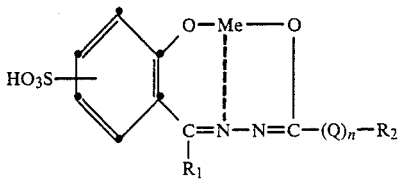

wherein $R_1$ and $R_2$ are each, independent of the other, hydrogen or an unsubstituted or substituted alkyl or aryl radical, Me is copper, Q is oxygen or NH and n is zero or 1, (4) a copper complex of the formula

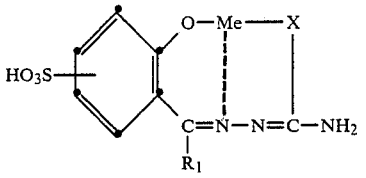

wherein $R_1$ and Me are as defined above, and X is oxygen or sulfur, and (5) a copper complex of a compound of the formula

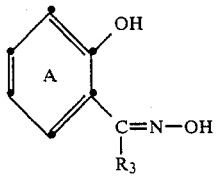

wherein $R_3$ is hydrogen, OH, alkyl or cycloalkyl, and wherein the ring A is unsubstituted or is further substituted by sulfo or sulfonamido.

2. Process according to claim 1, wherein the copper compound is selected from the group consisting of a copper salt of an inorganic or organic acid, and a copper salt of an inorganic or organic acid in admixture with a further organic carboxylic acid.

3. Process according to claim 2, wherein the copper compound is selected from the group consisting of copper chloride, copper sulfate, copper nitrate, copper acetate, copper tartrate and copper salicylate.

4. Process according to claim 2, where the copper compound is selected from the group consisting of copper chloride, copper sulfate, copper nitrate or copper acetate in admixture with an organic hydroxy carboxylic acid.

5. Process according to claim 1, wherein the compound of copper is an acylhydrazone copper complex of the formula

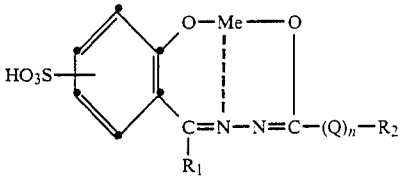

wherein $R_1$, $R_2$, Me, Q and n are as defined in claim 1.

6. Process according to claim 1, wherein the compound of copper is a copper complex of the formula

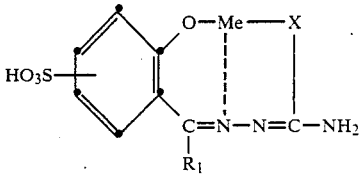

wherein $R_1$, Me and X are as defined in claim 1.

7. Process according to claim 1, wherein the compound of copper is a copper complex of a compound of the formula

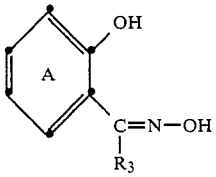

wherein $R_3$ and the ring A are as defined in claim 1.

8. Process according to claim 1, wherein the compound of copper is used in an amount of 0.1 to 10% by weight relative to the weight of the leather.

9. Process according to claim 8, wherein the amount employed is 0.5 to 5% by weight relative to the weight of the leather.

10. Process according to claim 1, wherein the leather, after dyeing, is treated with a salt of copper for improving the fastness to light.

11. Process according to claim 1, wherein the anionic dye is a cobalt or chrome-containing mono-, di- or polyazo, azomethine, formazan, anthraquinone, xanthene, nitro, triphenylmethane, naphthoquinoneimine or phthalocyanine dye.

12. Process according to claim 1, wherein the anionic dye is a 1:2-cobalt or 1:2-chrome complex of an azo or azomethine dye.

13. Process according to claim 1, wherein the anionic dye is a dye of the formula

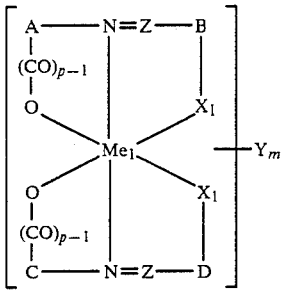

wherein

Z independently of one another are each nitrogen or a CH group,

A and C independently of one another are each a radical of the benzene or naphthalene series, which radical contains in the o-position with respect to the azo or azomethine group a hydroxyl or carboxyl group, B and D independently of one another are each the radical of a coupling component when Z is nitrogen, the coupling component containing in the o- or α-position with respect to the azo group the group X, or independently of one another are each the radical of an o-hydroxyaldehyde when Z is the CH group, $X_1$ independently of one another are each oxygen or a group of the formula —$NR_5$—, in which $R_5$ is hydrogen or a $C_1$–$C_4$-alkyl group, $Me_1$ is chromium or cobalt, Y is the $SO_3H$, COOH, $PO_3H_2$ or $SO_2$-V group, in which V is $C_1$–$C_4$-alkyl, unsubstituted or substituted by halogen, vinyl, amino, N-mono- or N,N-dialkylamino, p is 1 or 2, and m is an integer from 0 to 6.

14. Process according to claim 13, wherein the anionic dye is a dye of the formula

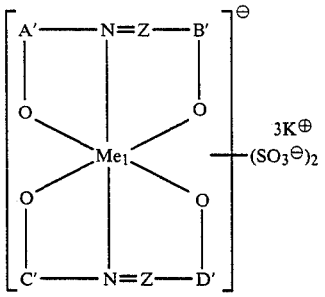

wherein

Z independently of one another are each a CH group or nitrogen,

A′ and C′ are each the radical of a 1-hydroxy-2-aminobenzene which carries in the 4- or 5- position a nitro group, or the radical of a 1-hydroxy-2-aminobenzene which carries in the 4-position a nitro group and in the 6-position a sulfo group, or the radical of a 1-hydroxy-2-aminobenzene which carries in the 6-position a nitro group and in the 4-position a sulfo group, B′ and D′ independently of one another are each the radical of one of the following coupling components, when Z is nitrogen: 1- or 2-naphthol which is unsubstituted or substituted by a sulfo group, m-phenylenediamine, resorcinol, p-alkyl($C_1$–$C_6$)-phenol, 1-phenyl-3-methyl-5-pyrazolone or acetoacetic acid anilide, and the phenyl group in the two last-mentioned compounds can be substituted by $C_1$–$C_4$-alkyl, $C_1$–$C_4$-alkoxy, chlorine or sulfo, or when Z is the CH group: the radical of an o-hydroxybenzaldehyde or o-hydroxynaphthaldehyde, which can each be substituted by phenylazo or sulfophenylazo, $Me_1$ is cobalt or chromium, and $Ka^{\oplus}$ is a cation.

15. Process according to claim 12, wherein the anionic dye is one of the dyes of the following formulae:

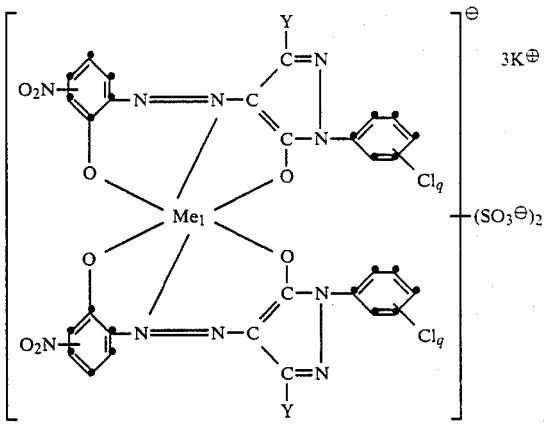

wherein q is an integer from O to 2, $Me_1$ is cobalt or chromium, $Ka^{\oplus}$ is a cation, and Y is methyl, —$CONH_2$ or —CO—NHR, in which R is an alkyl group having 1 to 4 C atoms;

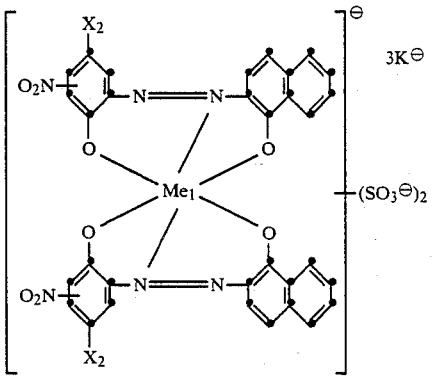

or of the formula

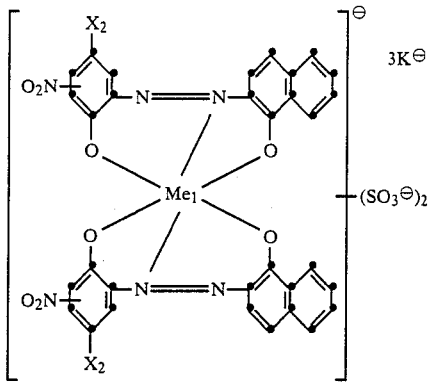

wherein $X_2$ is hydrogen, chlorine, methyl or methoxy, $Me_1$ is cobalt or chromium, and $Ka^{\oplus}$ is a cation; or of the formula

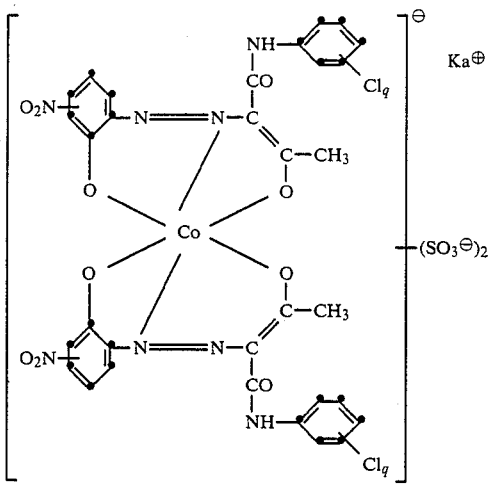

wherein q is an integer from 0 to 2, and $Ka^{\oplus}$ is a cation; or of the formula

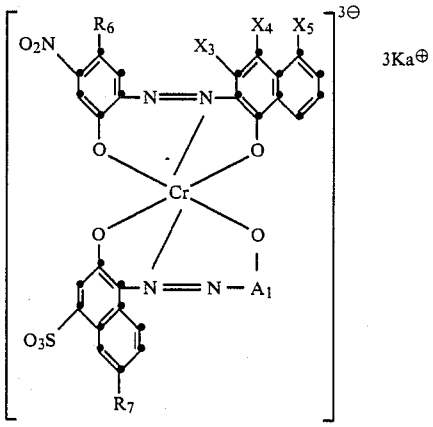

wherein $A_1$ is the radical of 1-hydroxynaphthalene or 2-hydroxynaphthalene, $R_6$ is hydrogen, chlorine or methyl, $R_7$ is hydrogen, nitro or chlorine, and $Ka^{\oplus}$ is a cation, and of the substituents $X_3$, $X_4$ and $X_5$, one is an $SO_3$ group and the two others are hydrogen, $X_5$ being hydrogen when $R_6$ is chlorine and $R_7$ hydrogen; or of the formula

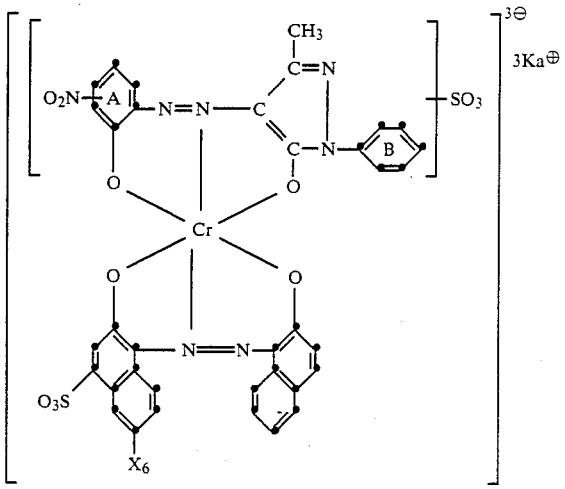

wherein $X_6$ is hydrogen, chlorine or nitro, and $Ka^{\oplus}$ is a cation, and wherein the sulfo group in the pyrazolone dye in the ring A or B and the nitro group in the ring A of this dye are arranged in the 4-, 5- or 6-position of the 1-hydroxy-2-aminobenzene; or of the formula

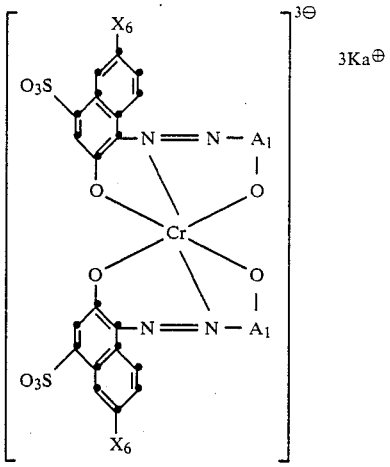

wherein $X_6$ is hydrogen, chlorine or nitro, $Ka^{\oplus}$ is a cation, and $A_1$ is the radical of 1-hydroxynaphthalene or 2-hydroxynaphthalene.

16. A process according to claim 4, wherein the organic hydroxy carboxylic acid is tartaric acid or salicylic acid.

* * * * *